US011851991B2

(12) United States Patent
King et al.

(10) Patent No.: US 11,851,991 B2
(45) Date of Patent: Dec. 26, 2023

(54) DOWNHOLE CONCENTRIC FRICTION REDUCTION SYSTEM

(71) Applicant: National Oilwell Varco, L.P., Houston, TX (US)

(72) Inventors: John M. King, Conroe, TX (US); Daniel Hernandez, Jr., Pasadena, TX (US); James R. Streater, Jr., Humble, TX (US); Paul Oberlin, Houston, TX (US)

(73) Assignee: National Oilwell Varco, L.P., Houston, TX (US)

( * ) Notice: Subject to any disclaimer, the term of this patent is extended or adjusted under 35 U.S.C. 154(b) by 75 days.

(21) Appl. No.: 17/496,896

(22) Filed: Oct. 8, 2021

(65) Prior Publication Data

US 2023/0111289 A1 Apr. 13, 2023

(51) Int. Cl.
*E21B 41/00* (2006.01)
*E21B 34/06* (2006.01)

(52) U.S. Cl.
CPC ..... *E21B 41/00* (2013.01); *E21B 34/06* (2013.01)

(58) Field of Classification Search
CPC ..... E21B 41/00; E21B 34/06
USPC ..... 166/317
See application file for complete search history.

(56) References Cited

U.S. PATENT DOCUMENTS

2014/0151068 A1 6/2014 Gilleylen et al.
2015/0075867 A1 3/2015 Eddison et al.
2018/0163495 A1* 6/2018 Kinsella ..... E21B 17/10
2019/0153820 A1* 5/2019 Lorenson ..... E21B 34/14
2020/0024924 A1 1/2020 Clausen et al.

FOREIGN PATENT DOCUMENTS

CA 2680895 A1 3/2011

OTHER PUBLICATIONS

International Search Report and Written Opinion dated Jan. 5, 2023, for Application No. PCT/US2022/045918.

* cited by examiner

*Primary Examiner* — Matthew R Buck
*Assistant Examiner* — Patrick F Lambe
(74) *Attorney, Agent, or Firm* — Conley Rose, P.C.

(57) ABSTRACT

A friction reduction system disposable in a wellbore includes a first valve member including an inner surface which includes a valve seat; and a second valve member rotatable concentrically about a central axis of the first valve member and including a radial port coverable by the valve seat of the outer valve member, wherein the friction reduction system includes an open configuration that provides a maximum flow area through a valve of the friction reduction system including the second valve member and the first valve member, wherein the friction reduction system includes a closed configuration that provides a minimum flow area through the valve which is less than the maximum flow area, and wherein the friction reduction system is configured to generate a pressure pulse in a fluid flowing through the friction reduction system in response to the friction reduction system transitioning from the open configuration to the closed configuration.

20 Claims, 7 Drawing Sheets

DOWNHOLE CONCENTRIC FRICTION REDUCTION SYSTEM

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

In some well systems a tool string may be lowered through a wellbore that extends through a subterranean earthen formation. The tool string may encounter friction as the tool string is lowered through the wellbore in response to contact between an outer surface of the tool string and a wall of the wellbore. For example, coiled tubing drilling systems may include a tool string including a bottom hole assembly (BHA) attached to coiled tubing which slides through a wellbore as a drill bit of the BHA drills into the earthen formation in which the wellbore is formed. Friction between the tool string and the wall of the wellbore may reduce a maximum reach of the tool string through the wellbore as friction between the tool string and the wall of the wellbore as the tool string is lowered through the wellbore may eventually overwhelm the capabilities of a surface system responsible for injecting the tool string into the wellbore.

SUMMARY

An embodiment of a friction reduction system disposable in a wellbore comprises a first valve member comprising an inner surface which comprises a valve seat, and a second valve member rotatable concentrically about a central axis of the first valve member and comprising a radial port coverable by the valve seat of the outer valve member, wherein the friction reduction system comprises an open configuration that provides a maximum flow area through a valve of the friction reduction system comprising the second valve member and the first valve member, wherein the friction reduction system comprises a closed configuration that provides a minimum flow area through the valve which is less than the maximum flow area, and wherein the friction reduction system is configured to generate a pressure pulse in a fluid flowing through the friction reduction system in response to the friction reduction system transitioning from the open configuration to the closed configuration. In some embodiments, the first valve member comprises an outer valve member and the second valve member comprises an inner valve member positioned radially within the outer valve member. In some embodiments, the friction reduction system comprises a radial bearing assembly positioned about the second valve member and which is configured to force the second valve member to rotate concentrically about the central axis of the first valve member. In certain embodiments, the friction reduction system comprises an outer housing in which the first valve member and the second valve member are received, and wherein the first valve member is coupled to the outer housing whereby rotation is restricted between the first valve member and the outer housing, wherein the second valve member comprises a mandrel including a central passage connected to the radial port. In certain embodiments, the radial port of the mandrel comprises a lower radial port the central passage comprises a lower passage, and wherein the mandrel further comprises an intermediate radial port, an upper radial port, and a central second passage extending between the upper radial port and the intermediate radial port, and a radial bearing is located about the mandrel and axially between the upper radial port and the lower radial port. In some embodiments, a bottom hole assembly comprising the friction reduction system, wherein the bottom hole assembly comprises a power section comprising a helical stator and a helical rotor that is rotatably disposed within the helical stator, wherein the stator is coupled to the outer housing of the friction reduction system and the rotor is coupled to the mandrel of the friction reduction system. In some embodiments, the first valve member comprises a plurality of the valve seats which are circumferentially spaced from each other about the central axis.

An embodiment of a friction reduction system disposable in a wellbore comprises an outer valve member comprising an inner surface which comprises an arcuate valve seat, and an inner valve member rotatable about a central axis of the outer valve member and comprising a radial port coverable by the valve seat of the outer valve member, wherein the friction reduction system comprises an open configuration that provides a maximum flow area through a rotary valve of the friction reduction system comprising the inner valve member and the outer valve member, wherein the friction reduction system comprises a closed configuration that provides a minimum flow area through the rotary valve which is less than the maximum flow area, and wherein the friction reduction system is configured to generate a pressure pulse in a fluid flowing through the friction reduction system in response to the friction reduction system transitioning from the open configuration to the closed configuration. In some embodiments, the maximum flow area is based on a perimeter of the radial port, and the minimum flow area is based on a perimeter of the radial port and a radial clearance formed between the radial port and the valve seat when the friction reduction system is in the closed configuration. In some embodiments, a perimeter of the valve seat is greater than the perimeter of the radial port. In certain embodiments, the friction reduction system comprises an outer housing in which the outer valve member and the inner valve member are received, and wherein the outer valve member is coupled to the outer housing whereby rotation is restricted between the outer valve member and the outer housing, wherein the inner valve member comprises a mandrel including a central passage connected to the radial port. In certain embodiments, a bottom hole assembly comprising the friction reduction system, wherein the bottom hole assembly comprises a power section comprising a helical stator and a helical rotor that is rotatably disposed within the helical stator, wherein the stator is coupled to the outer housing of the friction reduction system and the rotor is coupled to the mandrel of the friction reduction system. In some embodiments, the outer valve member comprises a plurality of the valve seats which are circumferentially spaced from each other about the central axis.

An embodiment of a friction reduction system disposable in a wellbore comprises a first valve member comprising a valve seat, and a second valve member rotatable about a central axis of the first valve member and comprising a radial port coverable by the valve seat of the first valve member, wherein the friction reduction system comprises an open configuration that provides a maximum flow area through a rotary valve of the friction reduction system comprising the second valve member and the first valve member, wherein the friction reduction system comprises a closed configuration that provides a minimum flow area through the rotary valve which is less than the maximum flow area, and wherein the radial port is positioned radially between the central axis of the first valve member and the valve seat when the friction reduction system is in the closed configuration, wherein the friction reduction system is configured to generate a pressure pulse in a fluid flowing through the friction reduction system in response to the friction reduction system transitioning from the open configuration to the closed configuration. In some embodiments, the first valve member comprises an outer valve member and the second valve member comprises an inner valve member positioned radially within the outer valve member. In some embodiments, the maximum flow area is based on a perimeter of the radial port, and the minimum flow area is based on a perimeter of the radial port and a radial clearance formed between the radial port and the valve seat when the friction reduction system is in the closed configuration. In some embodiments, the friction reduction system comprises an outer housing in which the first valve member and the second valve member are received, and wherein the first valve member is coupled to the outer housing whereby rotation is restricted between the first valve member and the outer housing, wherein the second valve member comprises a mandrel including a central passage connected to the radial port. In certain embodiments, the radial port of the mandrel comprises a lower radial port the central passage comprises a lower passage, and wherein the mandrel further comprises an intermediate radial port, an upper radial port, and a central second passage extending between the upper radial port and the intermediate radial port, and a radial bearing is located about the mandrel and axially between the upper radial port and the lower radial port. In certain embodiments, a bottom hole assembly comprising the friction reduction system, wherein the bottom hole assembly comprises a power section comprising a helical stator and a helical rotor that is rotatably disposed within the helical stator, wherein the stator is coupled to the outer housing of the friction reduction system and the rotor is coupled to the mandrel of the friction reduction system. In some embodiments, the first valve member comprises a plurality of the valve seats which are circumferentially spaced from each other about the central axis.

BRIEF DESCRIPTION OF THE DRAWINGS

For a detailed description of exemplary embodiments of the disclosure, reference will now be made to the accompanying drawings in which.

DETAILED DESCRIPTION

Figure 1:
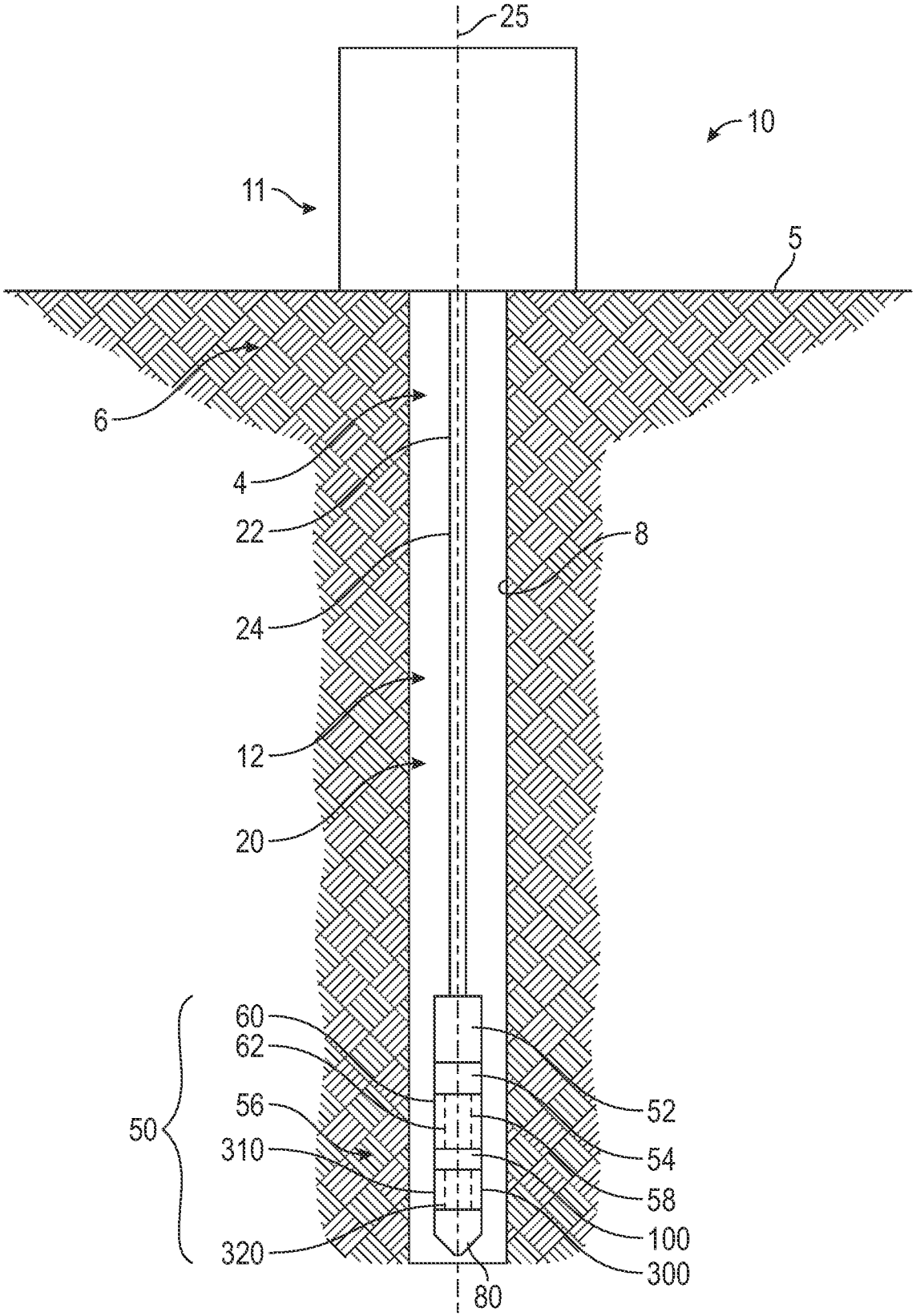
FIG. 1 is a schematic view of an embodiment of a well system.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Any reference to up or down in the description and the claims is made for purposes of clarity, with "up", "upper", "upwardly", "uphole", or "upstream" meaning toward the surface of the borehole and with "down", "lower", "downwardly", "downhole", or "downstream" meaning toward the terminal end of the borehole, regardless of the borehole orientation.

As described above, friction between a tool string and a wall of a wellbore as the tool string is conveyed through the wellbore may limit the maximum distance through which the tubing string may be extended through the wellbore. Additionally, friction between the tool string the wellbore wall may decrease the speed by which the tool string may be conveyed through the wellbore, thereby increasing the amount of time required to perform an operation in the wellbore (e.g., a drilling, completion, and/or production operation).

In some applications, the tool string may comprise a pressure pulse or friction reduction system (FRS) configured to induce oscillating axial motion in the tool string to thereby reduce friction between the tool string and the wellbore wall by preventing the tool string from sticking or locking against the wellbore wall. The FRS may include a pair of valve members or plates each including a flow passage and which rotate relative to each other. The flow passages of the valve plates may enter into and out of various degrees of alignment as the valve plates rotate relative to each other such that a minimum flow area may be provided periodically through the FRS. The provision of the minimum flow area through the FRS may result in the generation of a pressure pulse in fluid flowing therethrough due to the obstruction in fluid flow resulting from the minimum flow area, the pressure pulse thereby inducing oscillating axial movement of the tool string. Thus, the magnitude of the pressure pulse induced by the FRS may be dependent on the size of the minimum flow area through the FRS. Indeed, in at least some applications, the magnitude of the pressure pulse may be sensitive to slight changes in the size of the minimum flow area.

The minimum flow area may correspond to a relative angular position between the pair of valve plates which produces a minimal amount of overlap between the flow passages of the valve plates. Thus, the minimum flow area provided by the FRS, and hence the magnitude of the pressure pulse, may be dependent on the size of the minimal amount of overlap that may be formed between the fluid passages of the pair of valve plates. Moreover, in conventional FRSs, the minimum flow area may be produced from eccentric rotation of a first valve plate relative to a second valve plate of the FRS whereby a flow passage of the first valve plate enters into and out of alignment with a flow passage of the second valve plate. Endfaces of the first and second valve plates may slidably contact each other as the first valve plate travels eccentrically relative to the second valve plate. In such conventional, eccentric FRSs the size of the minimal amount of overlap between the flow passages first and second valve plates (defining the minimal flow area of the FRS) may depend on the respective manufacturing tolerances of the valve plates, as well as the manufacturing tolerances of the components with which the valve plates are assembled to form the FRS. Additionally, given that the first and second valve plates may slidably contact each other as the first valve plate travels eccentrically relative to the second valve plate, the pair of valve plates may comprise relatively hard, abrasion resistant materials which cannot be produced through conventional machining methods. For example, the pair of valve plates of an eccentric FRS may be formed from powdered carbine materials produced through the application of high temperatures and pressures. The tolerances of such materials due to their different form of production (e.g., via the application of high temperatures and pressures) may not be produced with a high degree of precision relative to conventionally machined materials.

Given that the size of the minimal flow area of an eccentric FS may be dependent upon the manufacturing tolerance of a plurality of components assembled or stacked together, as well as the limited precision associated with producing the abrasion resistant valve plates thereof, the size of the minimal flow area, and hence the magnitude of the pressure pulse, may vary substantially between similarly configured eccentric FRSs (e.g., FRSs comprising identically designed components). This variability and lack of precision in the pressure pulse induced by each similarly configured eccentric FRS may result in a pressure pulse that is either too weak to sufficiently reduce friction applied to the tool string or too strong whereby components of the tool string may become damaged due to the excessive oscillating axial motion induced by the overly great pressure pulse.

Accordingly, embodiments disclosed herein include FRSs comprising valve members which rotate concentrically, rather than eccentrically, and which are configured to not enter into sliding contact with each other during operation. Particularly, FRSs disclosed herein include a rotary valve in which a radially inner valve member rotates concentrically relative to an outer valve member. The inner valve member may be positioned radially within the outer valve member, rather than in end-to-end contact as with conventional, eccentric FRSs. The outer valve member may comprise a valve seat configured to entirely cover a radial port of the inner valve member whereby a closed configuration of the FRS is produced and which provides a minimal flow area. The valve seat may have a larger perimeter than the radial port such tolerance stack-up of the FRS and related components does not impact the size of the minimal flow area provided by the FRS. Instead, the minimal flow area may be based on a radial clearance formed between the radial port and the valve seat which may be conveniently tailored to in-turn tailor the minimal flow area (and the attendant pressure pulse produced by the FRS) suit a given application. The lack of sliding contact between the valve members may allow the valve members to be produced from conventional materials rather than relatively more exotic hardened materials such as powdered carbide materials. Additionally, the outer valve member may be provided with a varying number of circumferentially spaced valve seats whereby a frequency of the pressure pulses produced by the FRS produced at given fluid flow rate may be tailored to suit a given application.

Referring now to FIG. 1, a well or drilling system 10 for drilling a wellbore 4 extending into a subterranean formation 6 is shown. Drilling system 10 includes a surface assembly 11 positioned at a surface 5 and a tool string 20 deployable into wellbore 4 from the surface 5 using a surface assembly 11 positioned at the surface 5 atop the wellbore 4. Surface assembly 11 may comprise any suitable surface equipment for forming wellbore 4 and may include, for example, a pump, a tubing reel, a tubing injector, and a pressure containment device (e.g., a blowout preventer (BOP), etc.) configured to seal wellbore 4 from the surrounding environment at the surface 5.

Tool string 20 of drilling system 10 has a central or longitudinal axis 25 and includes a coiled tubing 22 which may be suspended within wellbore 4 and which is extendable from surface assembly 11. For example, coiled tubing 22 may be extendable from a tubing reel of surface assembly 11 using a coiled tubing injector of surface assembly 11. Coiled tubing 22 comprises a long, flexible metal pipe including a central bore or passage 24 through which fluids and/or other materials may be circulated therethrough, such as from a surface pump of surface assembly 11. Additionally, in some embodiments, signals may be communicated downhole from the surface assembly 11 via the coiled tubing 22.

Along with coil tubing 22, tool string 20 includes a BHA 50 connected to a terminal end of coiled tubing 22 such that BHA 50 is suspended in the wellbore 4 from coiled tubing 22. In this exemplary embodiment, BHA 50 generally includes an orientation sub 52, a telemetry sub 54, a downhole mud motor 56, and a drill bit 80 which is positioned at a terminal end of the BHA 50.

The orientation sub 52 of BHA 50 may include one or more actuators or other mechanisms for controlling the orientation of BHA 50 within wellbore 4 based on telemetry signals provided to a control system of orientation sub 52 by the telemetry sub 54. Telemetry sub 54 may include one or more sensors including measurement while drilling (MWD) sensors, such as inclination and azimuth sensors, that assist in guiding the trajectory of BHA 50 as the drill bit 80 of BHA 50 drills wellbore 4. BHA 50 may include components other than, and/or in addition to, those shown in FIG. 1.

Additionally, in other embodiments, BHA 50 may be utilized in a drilling system comprising a drill string that includes a plurality of drill pipes connected end-to-end rather than coiled tubing 22.

Downhole mud motor 56 of BHA 50 powers drill bit 80, permitting drill bit 80 to drill into the formation 6 and thereby form wellbore 4. Particularly, downhole mud motor 56 is configured to convert fluid pressure of a drilling fluid pumped downward through the central passage 24 of coiled tubing 22 into rotational torque for driving the rotation of drill bit 80. With force or weight applied to the drill bit 80, also referred to as weight-on-bit ("WOB"), the rotating drill bit 80 engages the earthen formation 6 and proceeds to form wellbore 4 along a predetermined path toward a target zone. In this exemplary embodiment, drilling fluid pumped down coiled tubing 22 and through downhole mud motor 56 may pass out of the face of drill bit 90 and back up an annulus 12 formed between tool string 20 and the wall 8 of borehole 4. The drilling fluid flowing through drill bit 80 may cool drill bit 50 and flush cuttings away from the face of bit 80, whereby the cuttings may be circulated through the annulus 12 to the surface 5.

In this exemplary embodiment, downhole mud motor 56 comprises a power section 58, a friction reduction system (FRS) 100, and a bearing assembly 300. Power section 58 comprises a stator 60 coupled to the telemetry sub 54 and a rotor 62 rotatably disposed in the stator 60. Stator 60 is configured to convert the fluid pressure into rotational torque. Particularly, stator 60 comprises a plurality of helical stator lobes while rotor 62 comprises a corresponding plurality of helical rotor lobes. Rotor 62 may have one fewer lobe than stator 60 whereby a series of cavities are formed between the stator 60 and rotor 62. Each cavity may be sealed from adjacent cavities by seals formed along the contact lines between stator 60 and rotor 62. Additionally, a central axis of rotor 62 is radially offset from a central axis of stator 60 by a fixed value known as the "eccentricity" of the rotor-stator assembly. Consequently, rotor 62 may be described as rotating eccentrically within stator 60.

In this exemplary embodiment, the assembly of stator 60 and rotor 62 forms a progressive cavity device, and particularly, a progressive cavity motor configured to transfer fluid pressure power section 58, drilling fluid is pumped under pressure into one end of the power section 58 where it fills a first set of open cavities. A pressure differential across the adjacent cavities forces rotor 62 to rotate eccentrically relative to the stator 60. As rotor 62 rotates inside stator 60, adjacent cavities are opened and filled with drilling fluid. As this rotation and filling process repeats in a continuous manner, the drilling fluid flows progressively down the length of power section 58 and continues to drive the rotation of rotor 62.

FRS 100 is coupled between the power section 58 and the bearing assembly of downhole mud motor 56. FRS 100 may also be referred to herein as a flow or pressure pulse system 100 and, as will be discussed further herein, is configured to reduce friction between the tool string 20 and a wall 8 of the wellbore 4 by generating a plurality of pressure pulses. The bearing assembly 300 comprises a bearing housing 310 coupled to stator 60, and a bearing mandrel 320 rotatably disposed in the bearing housing 310. Additionally, bearing mandrel 320 is coupled to the rotor 62 of power section 58 and to the drill bit 80 such that bearing mandrel 320 may transmit rotational torque from rotor 62 to the drill bit 80.

While in this exemplary embodiment FRS 100 is positioned between power section 58 and bearing assembly 300, in other embodiments, the positioning of FRS 100 along BHA 50 may vary. For example, in other embodiments, FRS 100 may be positioned between bearing assembly 300 and drill bit 80. In other embodiments, FRS 100 may be positioned above the power section 58 of BHA 50. In still other embodiments, FRS 100 may be positioned along BHA 50 and/or along tool string 20 spaced from the BHA 50. For example, a plurality of FRS 100 may be spaced along the tool string 20 at regular intervals.

Referring now to FIGS. 2-7, an embodiment of the FRS 100 of FIG. 1 is shown. In this exemplary embodiment, FRS 100 has a longitudinal or central axis 105 and generally includes an outer housing assembly 102, an inner mandrel assembly 150, and a bearing assembly 200, and a radial first or outer valve member 220. In this exemplary embodiment, outer housing 102 of FRS 100 includes a first or upper housing 104 and a second or lower housing 130 releasably coupled to upper housing 104.

Figure 2:
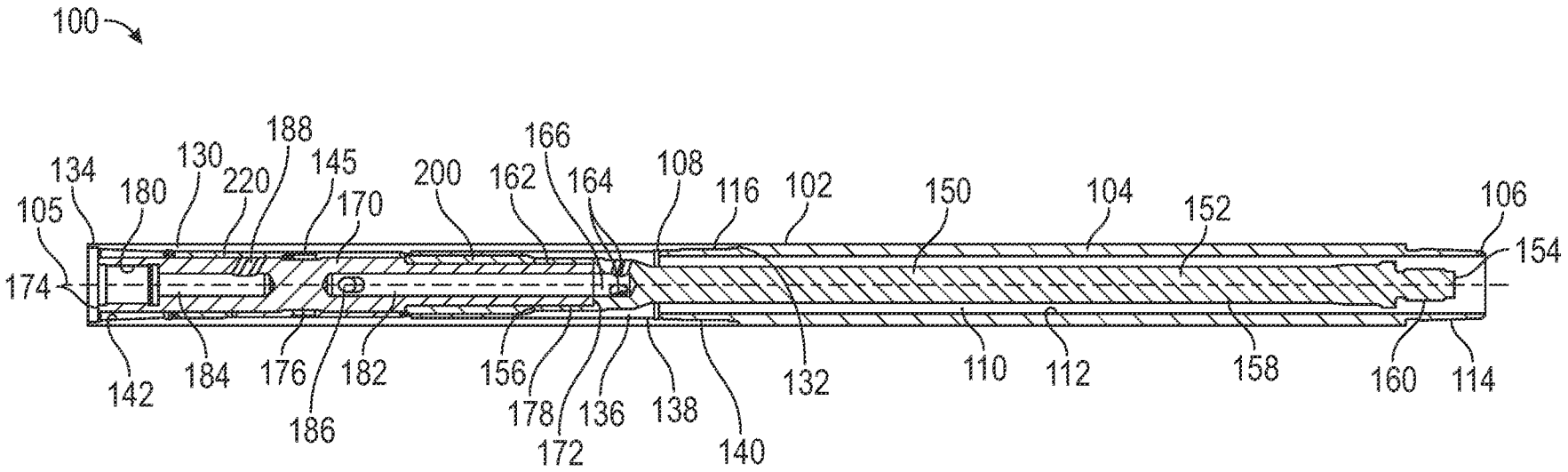
FIG. 2 is a side cross-sectional view of an embodiment of a friction reduction system (FRS) of the well system of FIG. 1 according to some embodiments.

As shown particularly in FIG. 2, upper housing 104 of the housing assembly 102 of FRS 100 generally includes a first or upper end 106, a second or lower end 108 opposite upper end 106, and a central bore or passage 110 defined by a generally cylindrical inner surface 112 extending between ends 106, 108. Upper housing 104 additionally includes a first or upper connector 114 positioned at the upper end 106 thereof and a second or lower connector 116 positioned at the lower end 108 thereof. In this exemplary embodiment, connectors 114, 116 each comprise externally threaded pin connectors; however, in other embodiments, the configuration of connectors 114, 116 may vary. Additionally, in this exemplary embodiment, upper connector 114 of upper housing 104 is configured to connect to a connector of the stator 60 of the power section 58 (not shown in FIGS. 2, 3) of downhole mud motor 56. Thus, a threaded connection may be formed between housing assembly 102 of FRS 100 and the stator 60 of power section 58 whereby relative rotation between stator 60 and housing assembly 102 is restricted.

Lower housing 130 of the housing assembly 102 of FRS 100 generally includes a first or upper end 132, a second or lower end 134 opposite upper end 132, and a central bore or passage 136 defined by a generally cylindrical inner surface 138 extending between ends 132, 134. Lower housing 130 additionally includes a first or upper connector 140 positioned at the upper end 132 thereof and a second or lower connector 142 positioned at the lower end 134 thereof. In this exemplary embodiment, connectors 140, 142 each comprise internally threaded box connectors; however, in other embodiments, the configuration of connectors 114, 116 may vary. Upper connector 140 of lower housing 130 is configured to connect (e.g., threadably connect) with the lower connector 116 of upper housing 104 whereby relative rotation between housings 104, 130 is restricted. Additionally, in this exemplary embodiment, the lower connector 142 of lower housing 130 is configured to connect (e.g., threadably connect) with a connector of the bearing housing 310 of bearing assembly 300 (not shown in FIGS. 2, 3) whereby relative rotation between bearing housing 310 and housing assembly 102 is restricted. Further, while in this exemplary embodiment outer housing assembly 102 comprises a plurality of housings 104, 130 coupled together, in other embodiments, outer housing assembly 102 may comprise a singular, monolithically or integrally formed outer housing (e.g., an outer housing comprising housings 102, 130 monolithically or integrally formed together). Thus, outer housing assembly 102 may also be referred to herein simply as outer housing 102.

Figure 3:
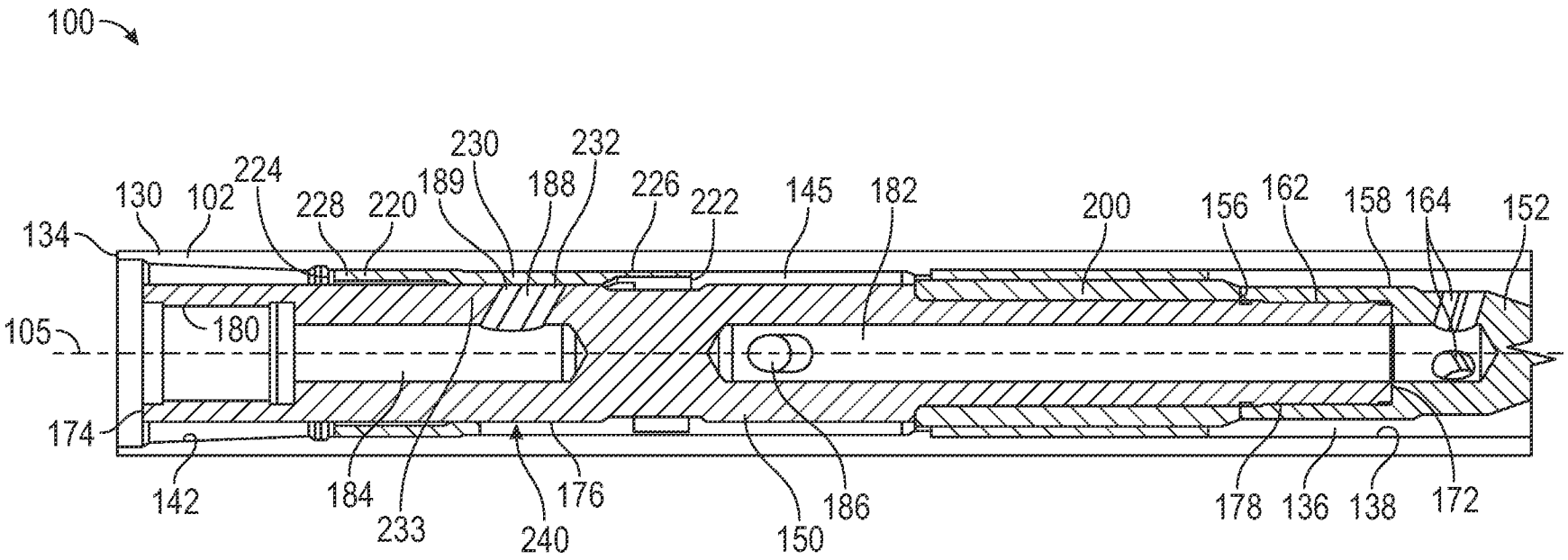
FIG. 3 is a zoomed-in, side cross-sectional view of the FRS of FIG. 2.
Figure 7:
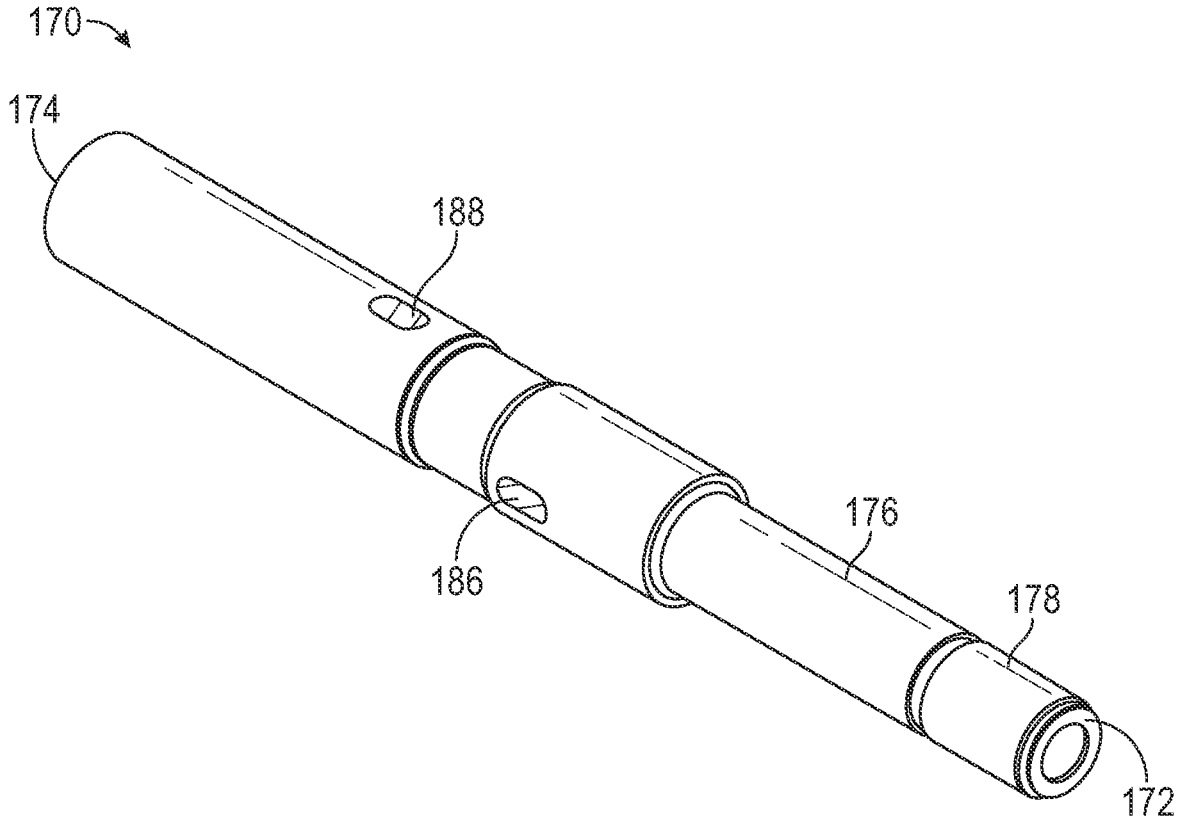
FIG. 7 is a perspective view of an embodiment of a lower mandrel of the FRS of FIG. 2.

As shown particularly in FIGS. 2, 3, and 7, the mandrel assembly 150 of FRS 100 generally includes a first or upper mandrel 152 and a second or lower mandrel 170 coupled to upper mandrel 152 to form mandrel assembly 150. Upper mandrel 152 of mandrel assembly 150 generally includes a first or upper end 154, a second or lower end 156 opposite upper end 154, and a generally cylindrical outer surface 158 extending between ends 154, 156. Upper mandrel 152 additionally includes a first or upper connector 160 positioned at the upper end 154 thereof and a second or lower connector 162 positioned at the lower end 156 thereof. In this exemplary embodiment, upper connector 160 comprises an externally threaded pin connector while lower connector 162 comprises an internally threaded box connector; however, in other embodiments, the configuration of connectors 160, 162 may vary. Additionally, in this exemplary embodiment, upper connector 160 of upper mandrel 160 is configured to connect to a connector of the rotor 62 of the power section 58 (not shown in FIGS. 2, 3, and 7) of downhole mud motor 56. Thus, a threaded connection may be formed between mandrel assembly 130 of FRS 100 and the rotor 62 of power section 58 whereby relative rotation between rotor 62 and mandrel assembly 130 is restricted. Additionally, given that relative rotation between rotor 62 and stator 60 of power section 58 is permitted, the mandrel assembly 130 is permitted to rotate relative (and in concert with rotor 62) to both stator 60 of power section 58 and the outer housing assembly 102 of FRS 100.

Lower mandrel 170 of mandrel assembly 150 generally includes a first or upper end 172, a second or lower end 174 opposite upper end 172, and a generally cylindrical outer surface 176 extending between ends 172, 174. Lower mandrel 170 additionally includes a first or upper connector 178 positioned at the upper end 172 thereof and a second or lower connector 180 positioned at the lower end 174 thereof. In this exemplary embodiment, upper connector 178 comprises an externally threaded pin connector while lower connector 180 comprises an internally threaded box connector; however, in other embodiments, the configuration of connectors 178, 180 may vary.

In this exemplary embodiment, the upper connector 178 of lower mandrel 170 is configured to connect (e.g., threadably connect) with the lower connector 162 of upper mandrel 152 whereby relative rotation between mandrels 152, 170 is restricted. Additionally, in this exemplary embodiment, the lower connector 180 of lower mandrel 170 is configured to connect (e.g., threadably connect) with a connector of the bearing mandrel 320 of bearing assembly 300 (not shown in FIGS. 2, 3, and 7) whereby relative rotation between bearing mandrel 320 and mandrel assembly 150 is restricted. Further, while in this exemplary embodiment mandrel assembly 150 comprises a plurality of mandrels 152, 170 coupled together, in other embodiments, mandrel assembly 150 may comprise a singular, monolithically or integrally formed mandrel (e.g., a mandrel comprising mandrels 152, 170 monolithically or integrally formed together). Thus, mandrel assembly 150 may also be referred to herein simply as outer mandrel 150.

In this exemplary embodiment, upper mandrel 152 of mandrel assembly 150 includes one or more circumferentially spaced radial upper ports 164 formed therein and located proximal the lower end 156 thereof. Upper mandrel 152 additionally includes a central passage extending into the lower end 156 thereof and which is in fluid communication with upper ports 164 whereby upper ports 164 extend radially between the central passage of upper mandrel 152 and the outer surface 158 of upper mandrel 152. The central passage of upper mandrel 152 only extends partially into upper mandrel 152 and thus terminates at a distance from the upper end 154 of upper mandrel 152.

Lower mandrel 170 includes 182 a first or upper central passage 182 (also referred to herein as upper passage 182) which extends into the upper end 172 of lower mandrel 170, and a second or lower central passage 184 (also referred to herein as lower passage 184) which extends into the lower end 174 thereof and which is spaced from upper central passage 182. Upper passage 182 of lower mandrel 170 is connected with the central passage of upper mandrel 152 and the central passage formed collectively by upper passage 182 of lower mandrel 170 and the upper passage 182 of lower mandrel 170 may also be referred to herein as upper passage 182. Upper passage 182 allows drilling fluid flowing through FRS 100 to bypass the bearing assembly 200 positioned within the annulus 145 formed between mandrel assembly 150 and outer housing assembly 102.

In this exemplary embodiment, lower mandrel 170 additionally includes a radial intermediate port 186 and a radial lower port 188 which are axially spaced from intermediate port 186. Intermediate port 186 extends radially between upper passage 182 and outer surface 176 while lower port 188 extends radially between lower passage 184 and outer surface 176. In this configuration, fluid may not be directly communication between upper passage 182 and lower passage 184, and instead, may only be communicated from upper passage 182 to lower passage 184 by travelling through intermediate port 186, an annulus 145 formed radially between mandrel assembly 150 and outer housing assembly 102, and the lower port 188. Additionally, while in this exemplary embodiment the lower mandrel 170 includes only a single intermediate port 186 and a single lower port 188, in other embodiments, lower mandrel 170 may include a plurality of circumferentially spaced intermediate ports 186 and/or a plurality of circumferentially spaced lower ports 188.

The bearing assembly 200 of FRS 100 is generally annular and positioned radially between the mandrel assembly 150 and outer housing assembly 102 of FRS 100. Bearing assembly 200 is generally configured to force mandrel assembly 150 of FRS 100 to rotate (at a rotational rate equal to the rotational rate of rotor 62) concentrically about central axis 105 of FRS 100. Central axis 105 is concentric with a longitudinal or central axis of outer housing assembly 102 and thus bearing assembly 200 serves to force mandrel assembly 150 to rotate concentrically about the central axis of outer housing assembly 102. Particularly, as described above, mandrel assembly 150 is coupled to the rotor 62 of power section 58. Also, as described above, rotor 62 rotates eccentrically with respect to the stator 60 of power section 58 whereby a central axis of the rotor 62 is offset from a central axis of the stator 62. Bearing assembly 200 acts to ensure mandrel assembly 150 rotates concentrically, rather than eccentrically (where forces from rotor 62 may otherwise urge mandrel assembly 150 into eccentric motion) with respect to outer housing assembly 102 and outer valve member 220.

In this exemplary embodiment, bearing assembly 200 comprises a radial bearing (e.g., comprising circumferentially spaced ball bearings, etc.) configured to support radial loads applied to the outer housing assembly 102 and/or mandrel assembly 150; however, in other embodiments, the configuration of bearing assembly 200 may vary.

Figure 4:
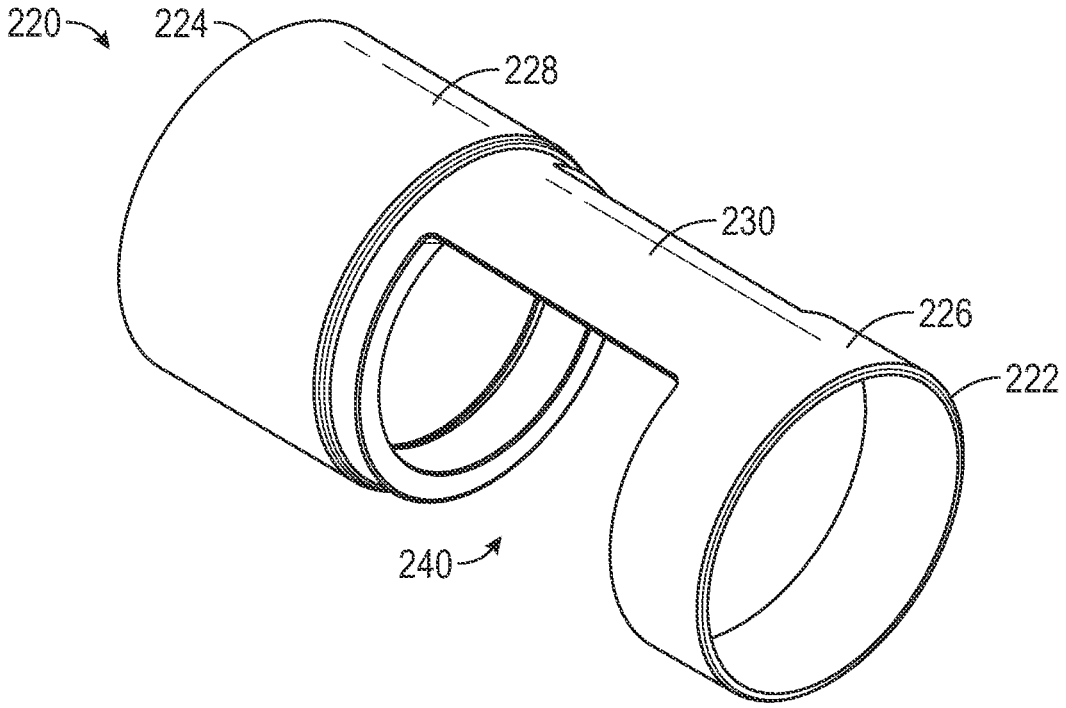
FIG. 4 is a perspective view of an embodiment of an outer valve member of the FRS of FIG. 2.
Figure 5:
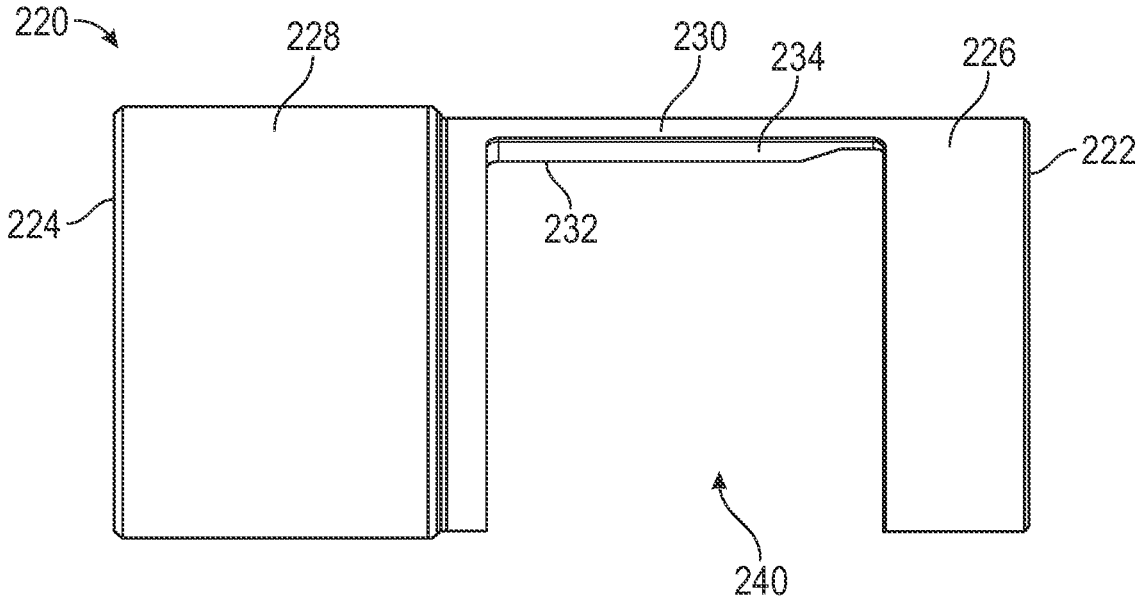
FIG. 5 is a side view of the outer valve member of FIG. 4.
Figure 6:
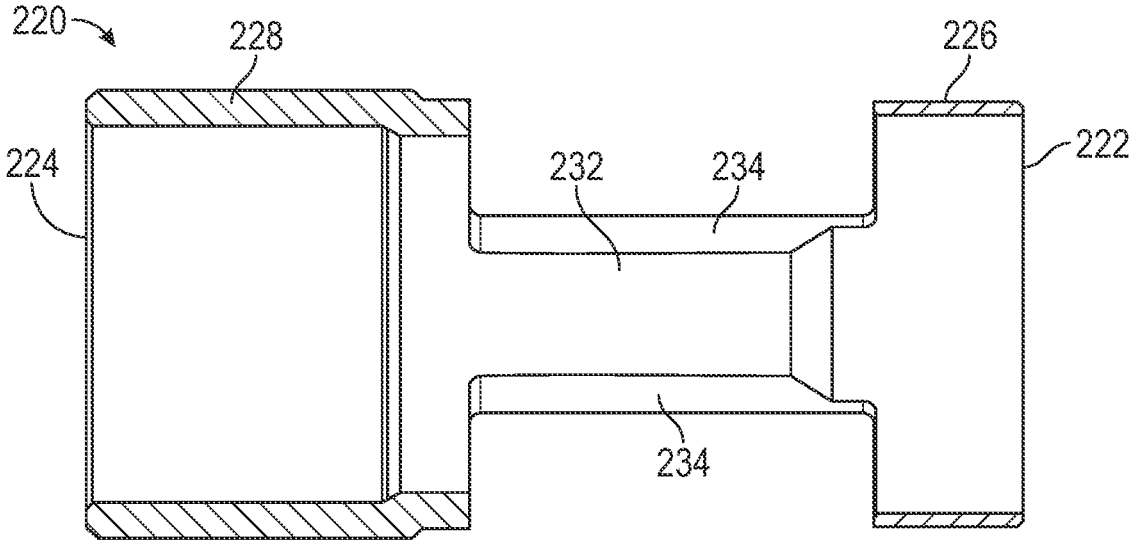
FIG. 6 is a side cross-sectional view of the outer valve member of FIG. 4.

As shown particularly in FIGS. 4-6, the outer valve member 220 of FRS 100 is generally cylindrical and includes a first or upper end 222, a second or lower end 224 opposite upper end 222. Additionally, in this exemplary embodiment, outer valve member 220 includes a first or upper ring 226 located at upper end 222 and a second or lower ring 228 located at lower end 224. Rings 226, 228 are separated by an arcuate detent 230 extending axially between rings 226, 228. As shown particularly in FIG. 6, detent 230 comprises an arcuate inner surface or valve seat 232 which is flanked by a pair of angled flanking surfaces each extending from the valve seat 232 to a generally cylindrical outer surface of the outer valve member 220. Valve seat 232 only extends partially about the circumference of outer valve member 220 whereby an arcuate gap or opening 240 is formed about the remaining portion of the circumference of outer valve member 220. In some embodiments, valve seat 232 defines a minimum inner diameter of outer valve member 220; however, in other embodiments, valve seat 232 may not define the minimum inner diameter of outer valve member 220.

In this exemplary embodiment, outer valve member 220 is coupled to the outer housing assembly 102 of FRS 100 whereby relative rotation between outer housing assembly 102 and outer valve member 220 is restricted. For example, outer valve member 220 may be press-fit into the outer housing assembly 102 whereby the outer surface of outer valve member 220 is locked to the inner surface 138 of the lower housing 130 of outer housing assembly 102. However, in other embodiments, the connection formed between outer valve member 220 and outer housing assembly 102 may vary. For example, in other embodiments, the outer valve member 220 may be threadably or otherwise coupled to the outer housing assembly 102 via one or more connectors. In still other embodiments, outer valve member 220 may be formed integrally or monolithically with the outer housing assembly 102 (e.g., integrally or monolithically with lower housing 130, for example). In further embodiments, only valve seat 232 may be formed or coupled with outer housing assembly 102 omitting rings 226, 228.

Figure 8:
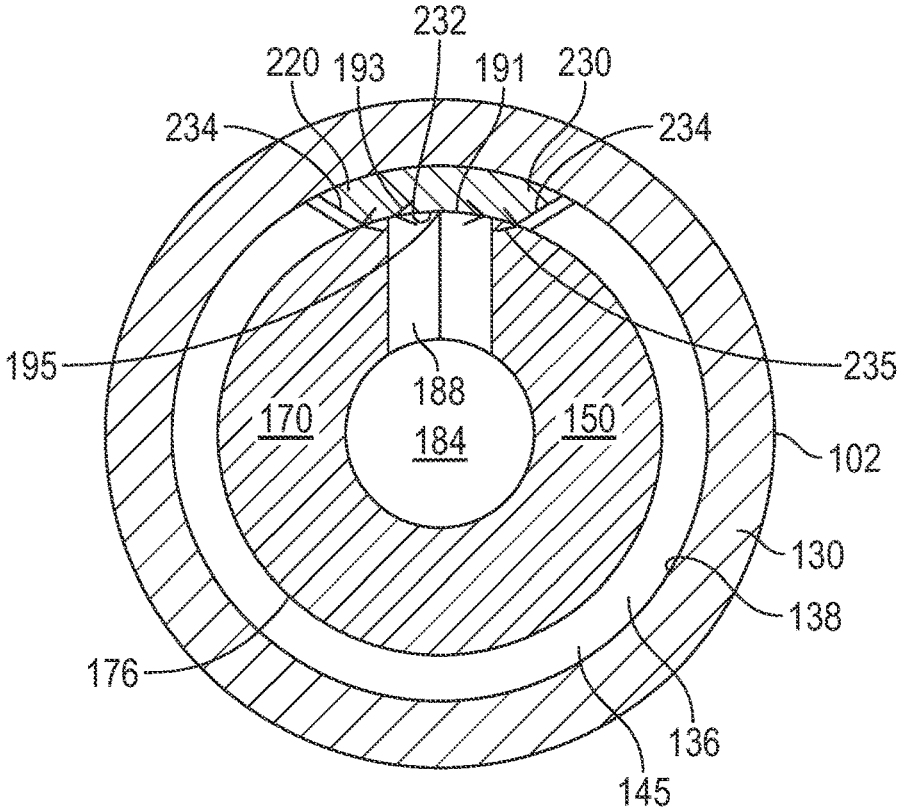
FIGS. 8, 9 are cross-sectional views along lines 8-8 in FIG. 3.
Figure 9:
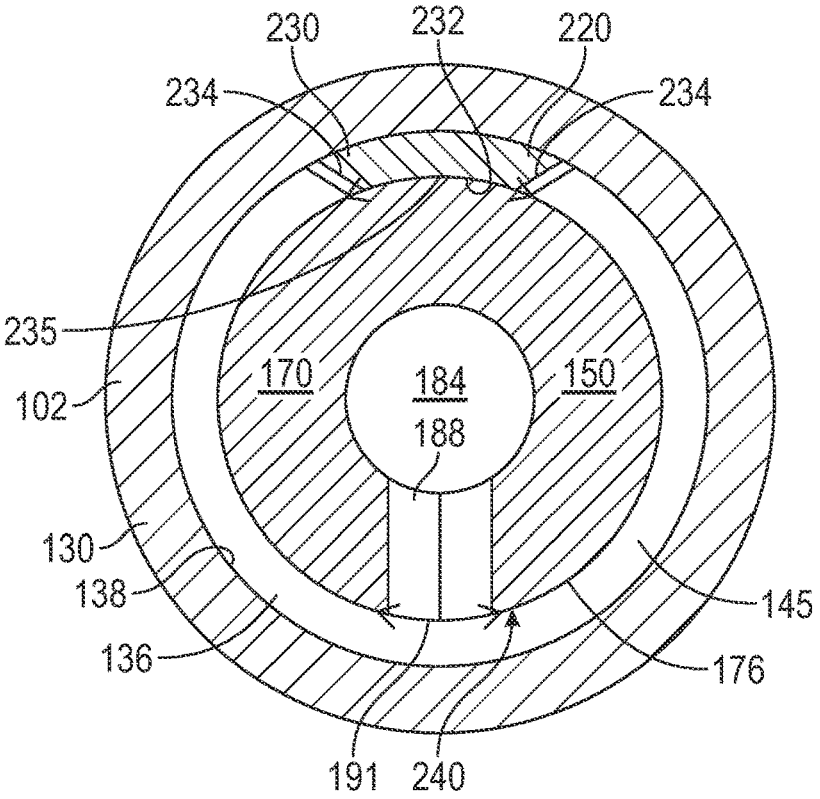

Referring now to FIGS. 3, 8, and 9, in this exemplary embodiment, mandrel assembly 150 and outer valve member 220 collectively form or comprise a rotary valve 250 in which mandrel assembly 150 forms a rotary second or inner valve member of the rotary valve 250. Thus, mandrel assembly 150 may also be referred to herein as the inner valve member 150 of rotary valve 250. While in this exemplary embodiment the mandrel assembly 150 is positioned radially within the outer valve member 220, in other embodiments, the relative positions of mandrel assembly 150 and outer valve member 220 may be reversed whereby, for example, radial port 188 is located radially outwards from the valve seat 230.

As mandrel assembly 150 rotates in concert with the rotor 62 of power section 58, lower port 188 of mandrel assembly 150 is cyclically covered or overlapped by the valve seat 232 of outer valve member 220. Rotary valve 250 of FRS 100 may continuously induce pressure pulses in the drilling fluid flowing through FRS 100 as mandrel assembly 150 rotates relative to outer valve member 220. The energy conveyed by the pressure pulses induced by FRS 100 is transferred to the coiled tubing 22 coupled to BHA 50, thereby periodically stretching the coiled tubing 22. The periodic stretching of coiled tubing 22 induced by the pressure pulses induced by FRS 100 may in-turn induce oscillating axial motion (motion in the direction of central axis 25) in the coiled tubing 22 (as well as in components of BHA 50) which helps prevent coiled tubing 22 and/or BHA 50 from sticking or locking against the wall 8 of wellbore 4, thereby reducing friction between the coiled tubing 22/BHA 50 and the wall 8 of the wellbore 4. Reducing friction between coiled tubing 22/BHA 50 and the wall 8 of wellbore 4 may increase the speed at which tubing string 20 may be conveyed through the wellbore 4 as well as increase the maximum distance or reach through which the tubing string 20 may extend through the wellbore 4.

As shown particularly in FIG. 3, valve seat 232 has an axial length 233 which is as great or greater than an axial length 189 of lower port 188. Additionally, as shown particularly in FIGS. 8, 9, valve seat 232 has an arcuate width 235 which is as great or greater than an arcuate width 191 of lower port 188. In this configuration, FRS 100 has a closed configuration shown in FIG. 8 in which valve seat 232 of outer valve member 230 entirely covers (both axially and circumferentially) lower port 188 whereby drilling fluid is substantially restricted from entering lower port 188 from annulus 145. Rotary valve 250 is configured to induce or generate a pressure pulse in the drilling fluid flowing through FRS 100 each time FRS 100 enters the closed configuration. Additionally, FRS 100 has an open configuration (an example of which is shown in FIG. 9) in which at least a portion of the lower port 188 is unobstructed or uncovered by the valve seat 232 of outer valve member 230.

As mandrel assembly 150 rotates relative to outer housing assembly 102 and outer valve member 220 the FRS 100 repeatedly cycles between the open and closed configurations, where the relative rotational rate between the mandrel assembly 150 and outer valve member 220 correlates to the frequency at which FRS 100 cycles between the open and closed configurations. Additionally, FRS 100 provides a minimum flow area through the rotary valve 250 when in the closed configuration and a maximum flow area through the rotary valve 250 when in the open configuration that is greater than the minimum flow area. The magnitude of the pressure pulse (e.g., the fluid pressure in the drilling fluid flowing through FRS 100) generated by rotary valve 250 at a given drilling fluid flowrate may be based on or correlate with the minimum flow area of rotary valve 250. Particularly, the magnitude of the pressure pulse generated by FRS 100 as it enters the closed configuration may be negatively correlated with the size of the minimum flow area through rotary valve 250 when in the closed configuration.

In some embodiments, the maximum flow area of rotary valve 250 may comprise or be based on a perimeter 193 of lower port 188 defined by the axial length 189 multiplied by the arcuate width 191 of the lower port 188. In embodiments where rotary valve 250 comprises a plurality of lower ports 188, the maximum flow area of rotary valve 250 may be multiplied by the number of lower ports 188. In some embodiments, the minimum flow area of rotary valve 250 may comprise or be based on the perimeter 193 of the lower port 188 multiplied by a radial clearance 195 between the lower port 188 and the valve seat 232 of outer valve member 230 when FRS 100 is in the closed configuration. In embodiments where rotary valve 250 comprises a plurality of lower ports 188, the minimum flow area of rotary valve 250 may be multiplied by the number of lower ports 188.

In view of the above, the maximum flow area of rotary valve 250 is based on the dimensions of lower port 188 (as well as the number of lower ports 188) while the minimum flow area of rotary valve 250 is based on the number/dimension of lower port 188 as well as the radial clearance 195 formed between lower port 188 and valve seat 232 where an increase in radial clearance 195 results in an increase in the minimum flow area of rotary valve 250. A ratio of the maximum flow area of rotary valve 250 to the minimum flow area of valve 250 may thus be conveniently tuned to the given application by adjusting the radial clearance 195. In-turn, by adjusting the ratio of the maximum flow area to the minimum flow area of rotary valve 250, the magnitude of the pressure pulse generated by FRS 100 for a given drilling flow rate may be adjusted to suit the needs of the given application. For instance, should a relatively greater pressure pulse be desired for a given drilling fluid flow rate, the radial clearance 195 of rotary valve 250 may be reduced. Conversely, should a relatively weaker pressure pulse be desired, the radial clearance 195 of rotary valve 250 may be increased. The pressure pulses generated by rotary valve 250 may be communicated to coiled tubing 22, thereby inducing oscillating axial motion in coiled tubing 22, as described above. A relatively greater magnitude of the pressure pulses generated by rotary valve 250 may be associated or correlated with a relatively greater magnitude in the oscillating movement induced in coiled tubing 22. Thus, by tuning the magnitude of the pressure pulses generated by rotary valve 250 as described above, the magnitude of the oscillatory movement induced in coiled tubing 22 may in-turn be tuned to fit the needs of a given application.

Moreover, given that the minimum and maximum flow areas are defined only by the relative dimensions of lower port 188, valve seat 230, and the radial clearance 195 extending therebetween, both the minimum flow area and maximum flow area provided by rotary valve 250 may be precisely controlled relative to conventional friction reduction systems which rely on a conventional friction reduction or pressure pulse system which relies on the eccentric motion of a first valve plate that is in sliding metal-to-metal contact with a second valve plate to open and close. Particularly, given that the first valve plate rotates eccentrically in concert with a helical rotor coupled therewith, the minimum flow area provided by the conventional friction reduction system is dependent upon the tolerance stack-up of the rotor to which it is coupled as well as other components (e.g., a helical stator) coupled to the conventional friction reduction system. Moreover, given that the conventional friction reduction system relies on sliding contact between its respective valve plates, the valve plates may generally comprise hardened materials (e.g., powdered carbide materials) which are formed through applying high pressures and temperatures in lieu of conventional machining procedures and which cannot be formed with the same level of precision as more conventional materials. Thus, the eccentric motion and hardened materials used in conventional friction reduction systems results in a lack of precision in both the minimum flow area provided by the friction reduction system and the resulting magnitude of the pressure pulse provided by the conventional system. These issues are avoided by FRS 100 which instead utilizes the concentric rotation of mandrel assembly 150 relative to outer valve member 220 and does not rely on sliding, metal-to-metal contact between mandrel assembly 150 and outer valve member 220. Moreover, as described above, the magnitude of the pressure pulse provided by FRS 100 may be conveniently adjusted by adjusting the radial clearance 195, something which cannot be done with the eccentrically rotated conventional friction reduction systems.

A portion of each cycle of the rotary valve 250 of FRS 100 is spent in the closed configuration shown in FIG. 8 and the open configuration shown in FIG. 9. The ratio of the portion of each cycle spent in the closed configuration versus the open configuration may be based on or correlate with the arcuate width 235 of valve seat 232 relative to the arcuate width of opening 240. Particularly, the greater the arcuate width 235 of valve seat 232 relative to the arcuate width of opening 240, the greater the ratio of the portion of each cycle spent in the closed configuration relative to the open configuration. Thus, ratio of the portion of each cycle spent in the closed configuration relative to the open configuration of FRS 100 may be conveniently tuned to the needs of a given application by adjusting the arcuate width 235 of valve plate 230 relative to the arcuate width of opening 240.

Figure 10:
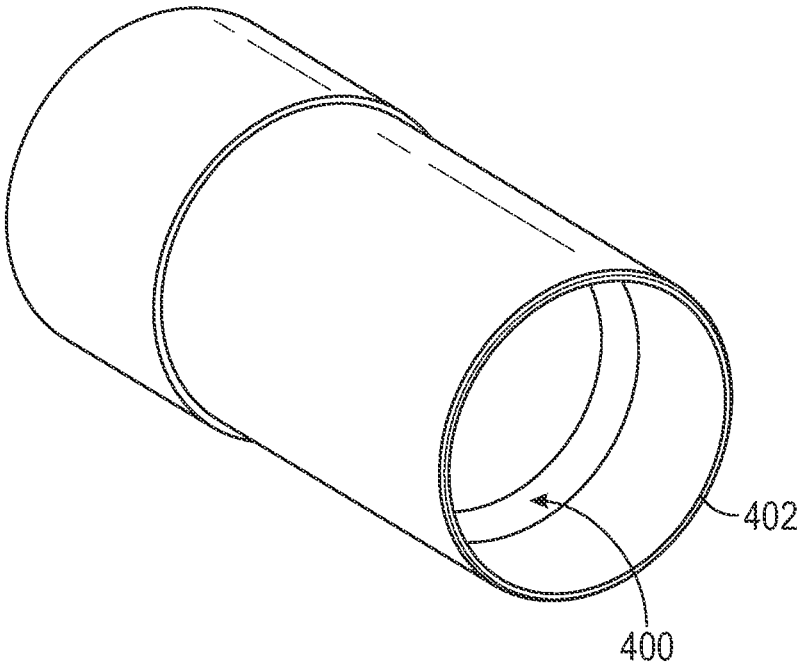
FIG. 10 is a perspective view of an embodiment of a sleeve from which an outer valve member may be produced.

Referring now to FIG. 10, a cylindrical sleeve 400 having a cylindrical inner surface 402 is shown from which an outer valve member, such as the outer valve member 220 described above, may be formed. Particularly, the cylindrical sleeve 400 may be manufactured to form one or more circumferentially spaced valve seats (e.g., one or more valve seats 230 described above) and one or more arcuate openings positioned circumferentially between the one or more valve seats. For example, sleeve 400 may be manufactured by standard forming, machining, and/or additive manufacturing processes. Additionally, the inner surface 402 of sleeve 400 may be machined to produce a desired minimum inner diameter for each formed valve seat with a high degree of precision to thereby tune the radial clearance (e.g., radial clearance 195 described above) as desired for the given application.

Figure 11:
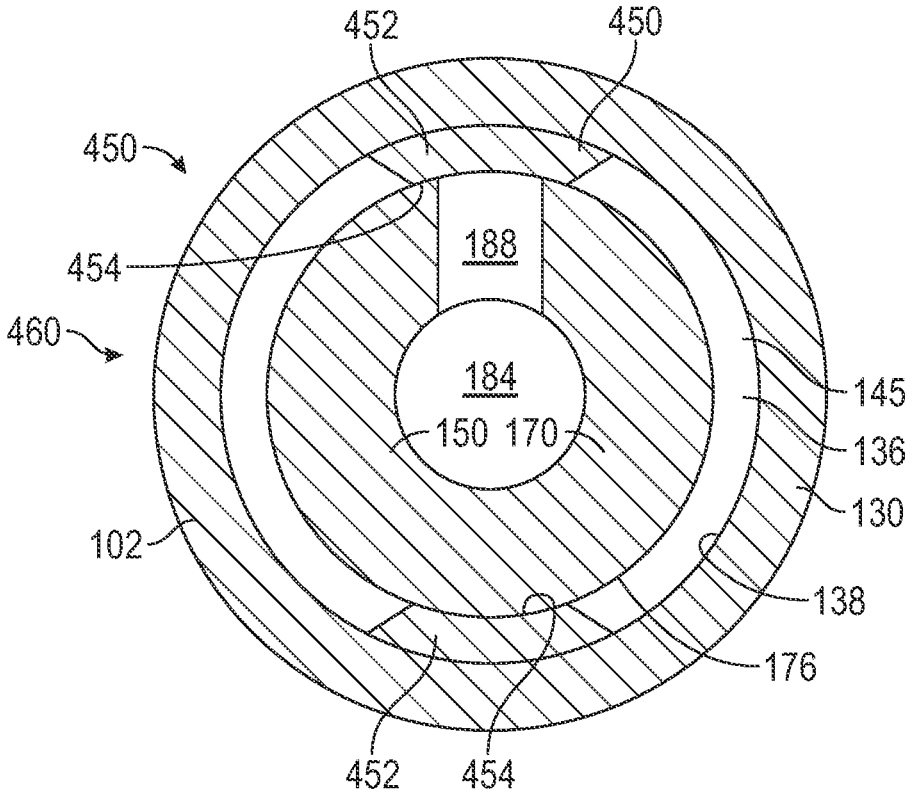
FIG. 11 is a cross-sectional view of another FRS.

As described above, in some embodiments, the outer valve member of the rotary valve of FRS 100 may include a plurality of circumferentially spaced outer valve members. For example, referring to FIG. 11, another embodiment of an outer valve member 450 is shown comprising a pair of circumferentially spaced detents 452. In this exemplary embodiment, each detent 452 is spaced approximately 180 degrees apart; however, in other embodiments, the circumferential spacing of detents 452 may vary. Additionally, in this exemplary embodiment, each detent comprises an arcuate inner surface or valve seat 454 configured to entirely cover the lower port 188 of mandrel assembly 150 when a friction reduction system (FRS) 460 comprising the mandrel assembly 150 and outer valve member 450 is in a closed configuration as shown in FIG. 11.

In this exemplary embodiment, FRS 460 enters the closed configuration twice (once for each of the pair of valve seats 454) during a single revolution of the mandrel assembly 150. Thus, at a given rotational rate, FRS 460 enters the closed configuration (and thereby produces a pressure pulse) at twice the frequency of the rotary valve 250 described above. Thus, by altering the number of valve seats of the outer valve member (which may be conveniently performed during the machining of sleeve 400 described above) a range of different frequencies of pressure pulses generated by the FRS 100 may be obtained at a single rotational rate of the mandrel assembly 150. A relatively greater frequency of pressure pulses generated by rotary valve 250 may be associated or correlated with a relatively greater frequency in the oscillating movement induced in coiled tubing 22. Thus, by tuning the frequency of the pressure pulses generated by rotary valve 250 as described above, the frequency of the oscillatory movement induced in coiled tubing 22 may in-turn be tuned to fit the needs of a given application.

Further, given that the rotational rate of mandrel assembly 150 may be limited by the particular application (e.g., by the surface equipment used to pump the drilling fluid to the FRS 100, for example), the ability to vary the frequency of the pressure pulses produced by FRS 100 at a given rotational rate of mandrel assembly 150 greatly enhances the flexibility of FRS 100 in suiting the needs of different applications. While in this exemplary embodiment outer valve member 450 comprises a pair of valve seats 452, in other embodiments, the number of valve seats 452 may be greater than two.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A friction reduction system disposable in a wellbore, comprising:

a first valve member comprising an inner surface which comprises a valve seat extending arcuately between a pair of opposed flanking surfaces whereby the valve seat defines a channel that extends arcuately from a first of the pair of flanking surfaces to a second of the pair of flanking surfaces; and a second valve member rotatable concentrically about a central axis of the first valve member and comprising a central passage and a radial port coverable by the valve seat of the first valve member;

wherein the friction reduction system comprises an open configuration in which fluid communication is established between the central passage of the second valve member and the arcuate channel, the open configuration providing a maximum flow area through a valve of the friction reduction system comprising the second valve member and the first valve member;

wherein the friction reduction system comprises a closed configuration in which fluid communication is restricted between the central passage of the second valve member and the arcuate channel, the closed configuration providing a minimum flow area through the valve which is less than the maximum flow area, and wherein the friction reduction system is configured to generate a pressure pulse in a fluid flowing through the friction reduction system in response to the friction reduction system transitioning from the open configuration to the closed configuration.

2. The friction reduction system of claim 1, wherein the first valve member comprises an outer valve member and the second valve member comprises an inner valve member positioned radially within the outer valve member.

3. The friction reduction system of claim 1, further comprising a radial bearing assembly positioned about the second valve member and which is configured to force the second valve member to rotate concentrically about the central axis of the first valve member.

4. The friction reduction system of claim 1, further comprising:

an outer housing in which the first valve member and the second valve member are received, and wherein the first valve member is coupled to the outer housing whereby rotation is restricted between the first valve member and the outer housing;

wherein the second valve member comprises a mandrel including a central passage connected to the radial port.

5. The friction reduction system of claim 4, wherein:

the radial port of the mandrel comprises a lower radial port the central passage comprises a lower passage, and wherein the mandrel further comprises an intermediate radial port, an upper radial port, and a central second passage extending between the upper radial port and the intermediate radial port; and a radial bearing is located about the mandrel and axially between the upper radial port and the lower radial port.

6. A bottom hole assembly comprising the friction reduction system of claim 4, wherein the bottom hole assembly comprises:

a power section comprising a helical stator and a helical rotor that is rotatably disposed within the helical stator, wherein the stator is coupled to the outer housing of the friction reduction system and the rotor is coupled to the mandrel of the friction reduction system.

7. The friction reduction system of claim 1, wherein the first valve member comprises a plurality of the valve seats which are circumferentially spaced from each other about the central axis.

8. A friction reduction system disposable in a wellbore, comprising:

an outer valve member comprising an inner surface which comprises an arcuate valve seat extending arcuately between a pair of opposed flanking surfaces whereby the valve seat defines a channel that extends arcuately from a first of the pair of flanking surfaces to a second of the pair of flanking surfaces; and an inner valve member rotatable about a central axis of the outer valve member and comprising a central passage and a radial port coverable by the valve seat of the outer valve member;

wherein the friction reduction system comprises an open configuration in which fluid communication is established between the central passage of the second valve member and the arcuate channel, the open configuration providing a maximum flow area through a rotary valve of the friction reduction system comprising the inner valve member and the outer valve member;

wherein the friction reduction system comprises a closed configuration in which fluid communication is restricted between the central passage of the second valve member and the arcuate channel, the closed configuration providing a minimum flow area through the rotary valve which is less than the maximum flow area, and wherein the friction reduction system is configured to generate a pressure pulse in a fluid flowing through the friction reduction system in response to the friction reduction system transitioning from the open configuration to the closed configuration.

9. The friction reduction system of claim 8, wherein:

the maximum flow area is based on a perimeter of the radial port; and the minimum flow area is based on a perimeter of the radial port and a radial clearance formed between the radial port and the valve seat when the friction reduction system is in the closed configuration.

10. The friction reduction system of claim 9, wherein a perimeter of the valve seat is greater than the perimeter of the radial port.

11. The friction reduction system of claim 8, further comprising:

an outer housing in which the outer valve member and the inner valve member are received, and wherein the outer valve member is coupled to the outer housing whereby rotation is restricted between the outer valve member and the outer housing;

wherein the inner valve member comprises a mandrel including a central passage connected to the radial port.

12. A bottom hole assembly comprising the friction reduction system of claim 11, wherein the bottom hole assembly comprises:

a power section comprising a helical stator and a helical rotor that is rotatably disposed within the helical stator, wherein the stator is coupled to the outer housing of the friction reduction system and the rotor is coupled to the mandrel of the friction reduction system.

13. The friction reduction system of claim 8, wherein the outer valve member comprises a plurality of the valve seats which are circumferentially spaced from each other about the central axis.

14. A friction reduction system disposable in a wellbore, comprising:

a first valve member comprising a valve seat extending arcuately between a pair of opposed flanking surfaces whereby the valve seat defines a channel that extends arcuately from a first of the pair of flanking surfaces to a second of the pair of flanking surfaces; and a second valve member rotatable about a central axis of the first valve member and comprising a central passage and a radial port coverable by the valve seat of the first valve member;

wherein the friction reduction system comprises an open configuration in which fluid communication is established between the central passage of the second valve member and the arcuate channel, the open configuration providing a maximum flow area through a rotary valve of the friction reduction system comprising the second valve member and the first valve member;

wherein the friction reduction system comprises a closed configuration in which fluid communication is restricted between the central passage of the second valve member and the arcuate channel, the closed configuration providing a minimum flow area through the rotary valve which is less than the maximum flow area, and wherein the radial port is positioned radially between the central axis of the first valve member and the valve seat when the friction reduction system is in the closed configuration;

wherein the friction reduction system is configured to generate a pressure pulse in a fluid flowing through the friction reduction system in response to the friction reduction system transitioning from the open configuration to the closed configuration.

15. The friction reduction system of claim 14, wherein the first valve member comprises an outer valve member and the second valve member comprises an inner valve member positioned radially within the outer valve member.

16. The friction reduction system of claim 14, wherein:

the maximum flow area is based on a perimeter of the radial port; and the minimum flow area is based on a perimeter of the radial port and a radial clearance formed between the radial port and the valve seat when the friction reduction system is in the closed configuration.

17. The friction reduction system of claim 14, further comprising:

an outer housing in which the first valve member and the second valve member are received, and wherein the first valve member is coupled to the outer housing whereby rotation is restricted between the first valve member and the outer housing;

wherein the second valve member comprises a mandrel including a central passage connected to the radial port.

18. The friction reduction system of claim 17, wherein:

the radial port of the mandrel comprises a lower radial port the central passage comprises a lower passage, and wherein the mandrel further comprises an intermediate radial port, an upper radial port, and a central second passage extending between the upper radial port and the intermediate radial port; and a radial bearing is located about the mandrel and axially between the upper radial port and the lower radial port.

19. A bottom hole assembly comprising the friction reduction system of claim 17, wherein the bottom hole assembly comprises:

a power section comprising a helical stator and a helical rotor that is rotatably disposed within the helical stator, wherein the stator is coupled to the outer housing of the friction reduction system and the rotor is coupled to the mandrel of the friction reduction system.

20. The friction reduction system of claim 14, wherein the first valve member comprises a plurality of the valve seats which are circumferentially spaced from each other about the central axis.

* * * * *